US012502008B2

(12) United States Patent
Adams

(10) Patent No.: US 12,502,008 B2
(45) Date of Patent: Dec. 23, 2025

(54) SELF-CONTAINED OUTDOOR FURNITURE COVERING

(71) Applicant: Dany Adams, Cambridge, MA (US)

(72) Inventor: Dany Adams, Cambridge, MA (US)

( * ) Notice: Subject to any disclaimer, the term of this patent is extended or adjusted under 35 U.S.C. 154(b) by 614 days.

(21) Appl. No.: 17/720,029

(22) Filed: Apr. 13, 2022

(65) Prior Publication Data

US 2022/0330712 A1 Oct. 20, 2022

Related U.S. Application Data

(60) Provisional application No. 63/175,362, filed on Apr. 15, 2021.

(51) Int. Cl.
*A47C 31/11* (2006.01)

(52) U.S. Cl.
CPC ..... *A47C 31/11* (2013.01)

(58) Field of Classification Search
CPC ..... A47C 31/11
USPC ..... 150/158
See application file for complete search history.

(56) References Cited

U.S. PATENT DOCUMENTS

| | | | | |
|---|---|---|---|---|
| 4,671,568 | A | 6/1987 | Greer | |
| 5,887,530 | A | 3/1999 | Muller | |
| 6,003,451 | A | 12/1999 | Kelldorf | |
| 6,951,368 | B2 | 10/2005 | Self | |
| 7,204,551 | B2 | 4/2007 | Kahan | |
| 7,757,614 | B2 * | 7/2010 | Nurse-Bey | A47G 11/004 108/90 |
| 2002/0178975 | A1 * | 12/2002 | Lewis | A47D 1/008 108/90 |
| 2005/0236876 | A1 | 10/2005 | Paulin | |
| 2012/0212019 | A1 | 8/2012 | Rodriguez et al. | |
| 2015/0115674 | A1 | 4/2015 | Watson | |
| 2015/0265064 | A1 | 9/2015 | Vigano et al. | |
| 2017/0290442 | A1 | 10/2017 | Rause | |
| 2017/0303699 | A1 | 10/2017 | Howe | |

FOREIGN PATENT DOCUMENTS

| | | | |
|---|---|---|---|
| CN | 203563955 | U | 4/2014 |
| CN | 203723757 | U | 7/2014 |
| CN | 210930474 | U | 7/2020 |
| WO | 2022/010543 | A1 | 1/2022 |

OTHER PUBLICATIONS

"Extended European Search Report received for EP Patent Application No. 22275047.3, mailed on Dec. 16, 2022", 8 pages.

* cited by examiner

*Primary Examiner* — Sue A Weaver
(74) *Attorney, Agent, or Firm* — Adler Pollock & Sheehan P.C.

(57) ABSTRACT

A cover for shielding an article of furniture such as sofas or chairs from external elements. The cover can be attached to a first part of the sofa or chair and extended by pulling the cover from the first part to a second part of the article of furniture. The cover can be made of a variety of materials including without limitation polypropylene, vinyl, polyester and plastic. The cover can also include zipper or other fasteners to secure the cover to or remove the cover from the furniture.

14 Claims, 9 Drawing Sheets

SELF-CONTAINED OUTDOOR FURNITURE COVERING

CROSS-REFERENCE TO RELATED APPLICATIONS

This application claims the benefit of U.S. Provisional Patent Application No. 63/175,362 filed Apr. 15, 2021, which is incorporated herein by reference.

FIELD OF THE INVENTION

The present invention generally relates to furniture protection, and in particular, to self-contained covering for outdoor article of furniture.

BACKGROUND

In general, outdoor furniture needs to be protected from nature and the elements. It is laborious to place free-flowing covers on outdoor furniture and anything else that resides unprotected outside, such as, for example, grills. It is even more troublesome to find a way and a place to store free-flowing protective coverings when they are not in use. Storing protective, outside-furniture coverings usually requires carrying around dirty, unwieldy, and heavy piles of fabric or leaving them in an unsightly pile. While some people only go through covering and uncovering outside furniture a couple of times a year, others do it every time they want to sit outside. Some protective covers come with bags into which it is practically impossible to roll a protective cover, making those bags useless.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In an aspect, the invention features a system including an outdoor article of furniture, and a covering, the covering being retractable and stored in a first portion of the outdoor article of furniture, the covering having an attachment mechanism to secure to a second portion of the outdoor article of furniture and shield an upper portion of the outdoor article of furniture from external elements.

In one embodiment, a system includes an article of furniture (e.g., chair, sofa) and a covering that can be attached to a first portion of the article of furniture. The covering can be retractable. The covering can be pulled or extended from the first portion to a second portion of the article of furniture for shielding the article of furniture. For example, the covering can shield an upper portion, a lower portion, a front portion and/or a rear portion of the article of furniture from external elements.

In one embodiment, the covering can have an elastic material about the borders or edges of the covering such that the covering can provide better fit with the various portions of the article of furniture. In other words, because of the compressive property of the elastic material, when the covering is placed over the article of furniture, the covering can provide tighter fit with the article of furniture including the upper portion, lower portion, front portion and rear portion thereof.

In one embodiment, the first portion of the article of furniture is located along a lower portion or a front portion of the article of furniture and the second portion is located along a rear portion or an upper portion of the article of furniture. Alternatively, the converse may be true whereby the first portion can be located along a rear portion or an upper portion of the article of furniture and the second portion can be located along a lower portion or a front portion of the article of furniture.

In one embodiment, the covering can include a fastener for securing a first portion of the covering to a second portion of the covering. For example, the covering can be opened about the middle of the cover such that two parts of the covering (e.g., left side and right side) can be joined with a fastener such as a zipper, magnets, or hook and loop fastener (e.g., Velcro®). The fastener can be attached in the appropriate places throughout the covering as can be appreciated by one skilled in the art and will not be elaborated further herein. In some embodiments, the covering can have a handle to make it easier for a user to extend the covering from the first portion to the second portion of the article of furniture.

In one embodiment, the covering may have a first attachment device while the second portion of the article of furniture may have a second attachment device. Alternatively, the second portion of the article of furniture may include the first attachment device while the covering may include the second attachment device. In operation, the second attachment device is configured to receive the first attachment device for securing the covering to the article of furniture, or vice versa.

In one embodiment, the first attachment device can be a latch or a catch, and the second attachment device can be a recess, or a groove configured to receive the latch or the catch. In another embodiment, the first attachment device can be a spring, and the second attachment device can be a tab configured to receive the spring.

In one embodiment, a system includes an article of furniture having a back support and a covering that adjacent to the back support. In this embodiment, the covering is configured to extend from the back support to at least one of an upper portion, a lower portion, a front portion and a rear portion of the article of furniture for shielding the article of furniture from external elements.

In one embodiment, the covering can be stored within a storage compartment along a rear portion of the back support of the article of furniture.

In one embodiment, the covering can be stored within a cushion adjacent the front portion of the back support of the article of furniture.

In one embodiment, the covering can have a first attachment device while the lower portion or the front portion of the article of furniture may have a second attachment device. The second attachment device can be configured to receive the first attachment device, for securing the covering to the article of furniture.

In one operation, these attachment devices can be reversed yet perform the same or similar function. In other words, the first attachment device can be on the lower portion or the front portion of the article of furniture and the second attachment device can be on the covering. The attachment devices can be coupled together such that the covering can be secured to the article of furniture.

In one embodiment, a method of utilizing the disclosed systems herein include initially providing a covering for an article of furniture. In the next step, the method includes attaching the covering to a first portion of the article of furniture. The next step of the method involves extending the covering from the first portion to a second portion of the article of furniture whereby the covering is operable to shield at least one of an upper portion, a lower portion, a front portion and a rear portion of the article of furniture from external elements.

In one embodiment, the method further includes the step of securing the covering to the article of furniture with first attachment device configured to receive second attachment device. In one embodiment, the first attachment device can be on the covering and the second attachment device can be on the second portion of the article of furniture. In another embodiment, the first attachment device can be on the second portion of the article of furniture and the second attachment device can be on the covering.

In one embodiment, the method may further include the step of securing a first portion of the covering to a second portion of the covering with a fastener, whereby the fastener is at least one of zipper, magnet, and hook and loop fastener.

The disclosed embodiments may include one or more of the following advantages: providing a hidden or inconspicuous containment system (e.g., storage compartment) that can be built into or attached to a piece of furniture (e.g., chair) for housing an attached, fitted cover for the article of furniture such as an outdoor chair or sofa. The storage compartment can be on the back side of the back support in the form of a false back, or on the front side of the back support in the form of cushions or pillows that may or may not be integrated with the back support.

Other benefits of the present disclosure include, among others, covering that protect the entire chair or sofa, not just pillows. Additionally, the covering may also be engineered to be inserted easily into the containment system. In other words, the covering may be a self-contained system. Last but not least, the covering can be easily pulled out and extended to provide shielding or protection for any pieces of furniture or non-furniture.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
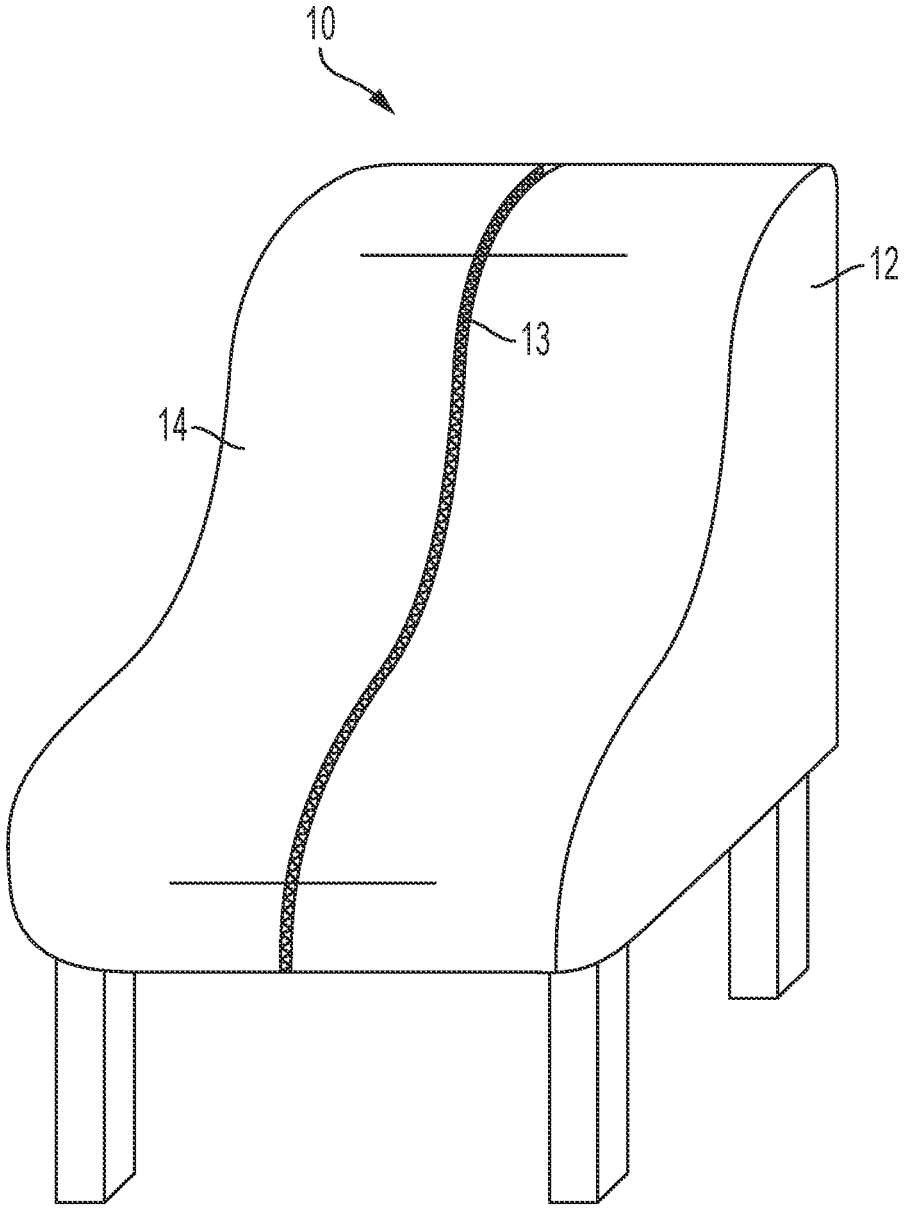
FIGS. 1, 2A and 2B illustrate a first embodiment of an exemplary system.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIG. 1, an exemplary system 10 includes an article of furniture 12 and a covering 14. The covering 14 may be retractable. In other words, the covering 14 may be converted from a storage configuration (e.g., retracted) to an in-use configuration (e.g., extended), and vice versa. Although the article of furniture 12 as shown is a chair, the system 10 may include other types of furniture, such as a couch or table. Moreover, in other embodiments, the covering 14 in accordance with the present disclosure may be used on other non-furniture types of articles (e.g., grill, stove top). While the article of furniture 12 discussed herein are mostly for outdoor furniture made of plastic, metal or wood, among other suitable weather-proof materials, it is understood and appreciated that the presently disclosed embodiments can apply equally to in-door furniture including sofas and chairs alike.

In the embodiment shown in FIG. 1, the covering 14 can be extended over the article of furniture 12 so as to provide protection from environmental elements such as rain, sun, pollen, leaves, bird droppings, and so forth. The covering 14 may be constructed from a variety of materials or outdoor fabrics such as a polypropylene fabric, marine vinyl, woven textiles made from acrylic, synthetic fibers, blends of cotton, polyester, linen, among others.

In one embodiment, the covering 14 may have a fastener 13 such as a zipper or set of magnets or other hook and loop fasteners (e.g., Velcro®) to facilitate covering and uncovering of the covering 14 to the article of furniture 12 such as a chair or sofa. In the alternative, the fastener 13 may help to facilitate in securing a first portion (e.g., left portion) of the covering 14 to a second portion (e.g., right portion) of the covering 14. As shown, the fastener 13 is located in the middle of the covering 14. In the alternative, the fastener 13 need not be located in the middle of the covering 14 but instead can be located on the sides or edges of the covering 14 (not shown). In some embodiments, the fastener 13 need not be necessary and the covering 14 can be a single, unitary piece of cover that can be pulled or extended over the entire article of furniture 12.

Figure 2A:
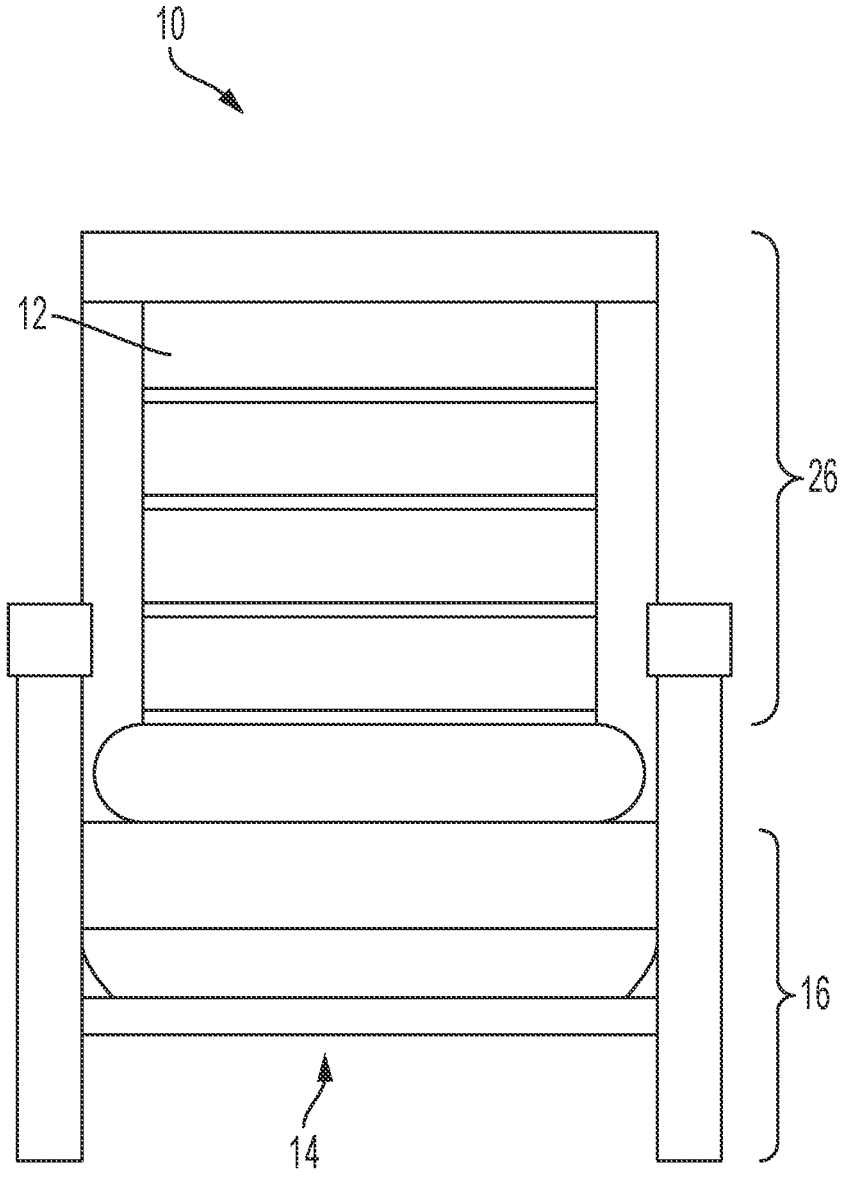

In FIG. 2A, the covering 14 is shown in the storage configuration, whereby the covering 14 is under a lower portion 16 of the article of furniture 12. While the covering 14 is shown in a first or lower portion 16, it is possible that the covering 14 can also be stored in a second or upper portion 26 of the article of furniture 12. The covering 14 can be housed or attached to the article of furniture 12 via any suitable attachment mechanism.

For example, the covering 14 can be attached to a first portion or a second portion of the article of furniture 12. In operation, if the covering 14 is attached about a first portion, the covering 14 can be extended to a second portion from the first portion or retracted therefrom. Similarly, the converse may be true whereby if the covering 14 is attached about a second portion, the covering 14 can be extended to a first portion from the second portion or retracted therefrom.

In one embodiment, in the storage configuration, the covering 14 may be rolled up around a spring-loaded mechanism located in a storage housing positioned under the lower portion 16 of the article of furniture 12.

Figure 2B:
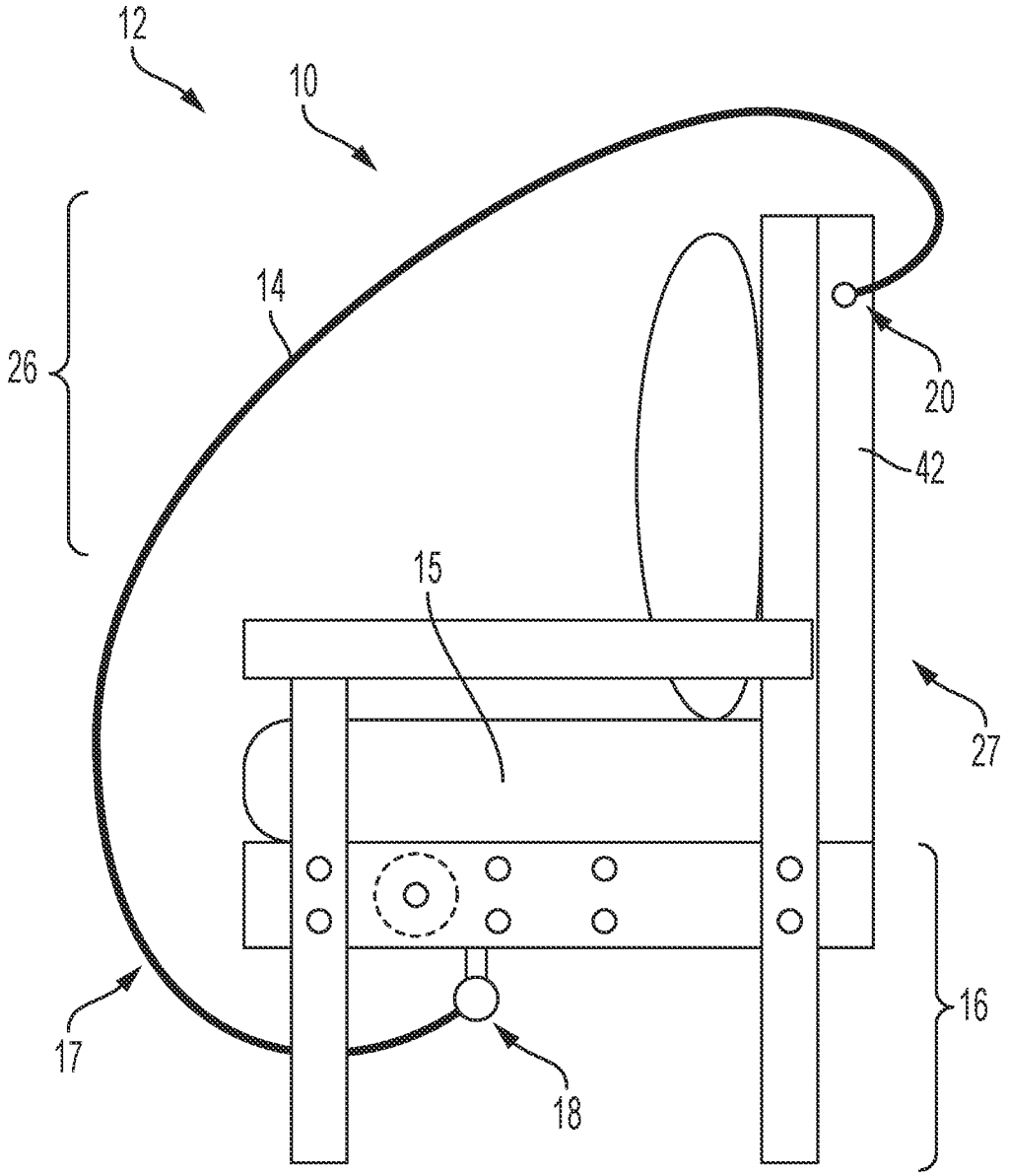

As shown in FIG. 2B, in a side view, in addition to the upper portion 26 and the lower portion 16, the article of furniture 12 also includes a front portion 17 and a rear portion 27. The front portion 17 is generally the portion that a user faces or engages with the article of furniture 12 (e.g., see FIG. 2A where a user goes to sit down on a seat bottom 15), while the rear portion 27 is generally the back or backside of the article of furniture 12.

In one embodiment, as best illustrated in FIG. 2B (e.g., in an in-use configuration), when the covering 14 is extended from the lower portion 16 to the upper portion 26 (or from the front portion 17 to the rear portion 27), the covering 14 is generally able to shield mostly the front portion 17 and the upper portion 26. In other words, the covering 14 is able to shield the areas where a user is typically engaging with the article of furniture 12 (e.g., seat bottom 15 and seat back 42).

In some embodiments, the covering 14 may include additional fabrics or materials such that not only are the front portion 17 and the upper portion 26 covered or protected when the covering 14 is extended, but that the rear portion 27 as well as the lower portion 16 are protected or shielded from external elements as well. In some embodiments, when the covering 14 is extended from the upper portion 26 to the lower portion 16 (or from the rear portion 27 to the front portion 17), or vice versa, the covering 14 is able to shield at least parts of the upper portion 26, the lower portion 16, the front portion 17 and/or the rear portion 27 from external elements.

In one embodiment, the covering 14 includes a handle/latch 18. In operation, the handle/latch 18 can be grasped by a user to actuate the covering 14 from its storage configuration to an in-use configuration (and vice versa) by drawing the covering 14 across the article of furniture 12. In other words, the handle/latch 18 helps to facilitate the covering 14 being extended from the lower portion 16 to the upper portion 26, and vice versa (e.g., retracted). Similarly, the handle/latch 18 can also help to facilitate the covering 14 being extended from the front portion 17 to the rear portion 27, and vice versa (e.g., retracted).

In one embodiment, the handle/latch 18 can be placed into a rack notch 20 located on an upper portion 26 of a back support 42 of the article of furniture 12, thereby securing the covering 14 across the article of furniture 12. Removing the handle/latch 18 from the rack notch 20 enables the covering 14 to be drawn back or retracted into its storage configuration under the lower portion 16 of the article of furniture 12.

Figure 3A:
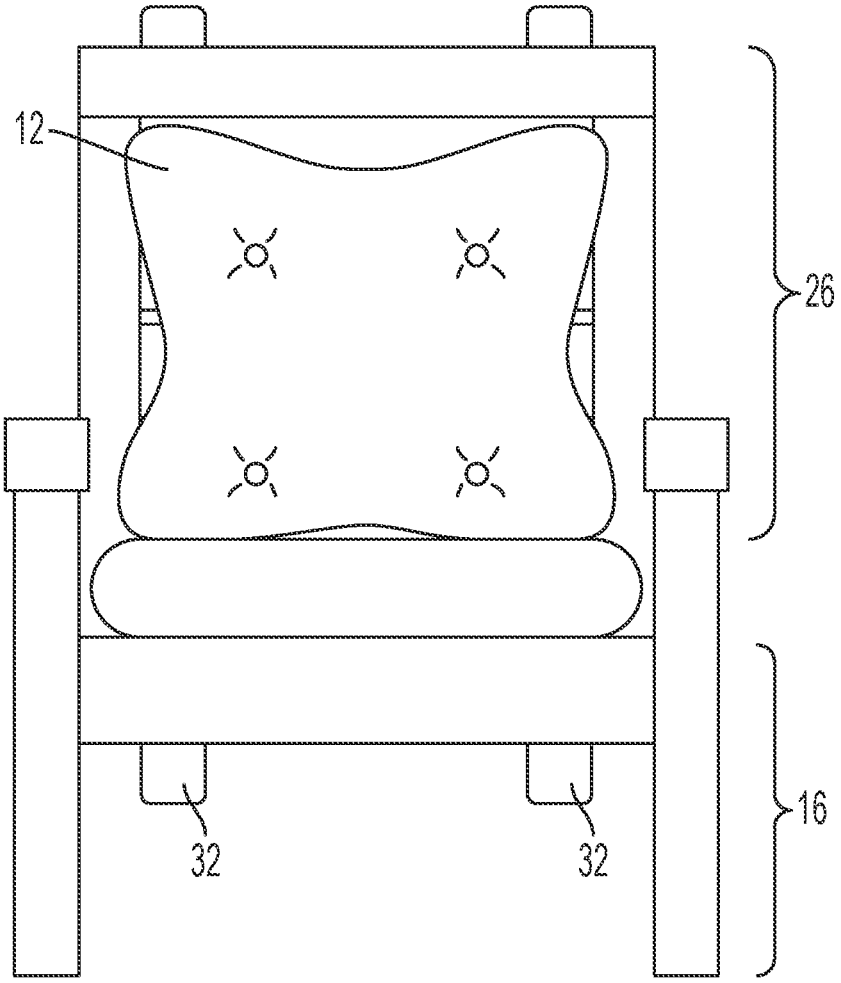
FIGS. 3A and 3B illustrate a second embodiment of an exemplary system.
Figure 3B:
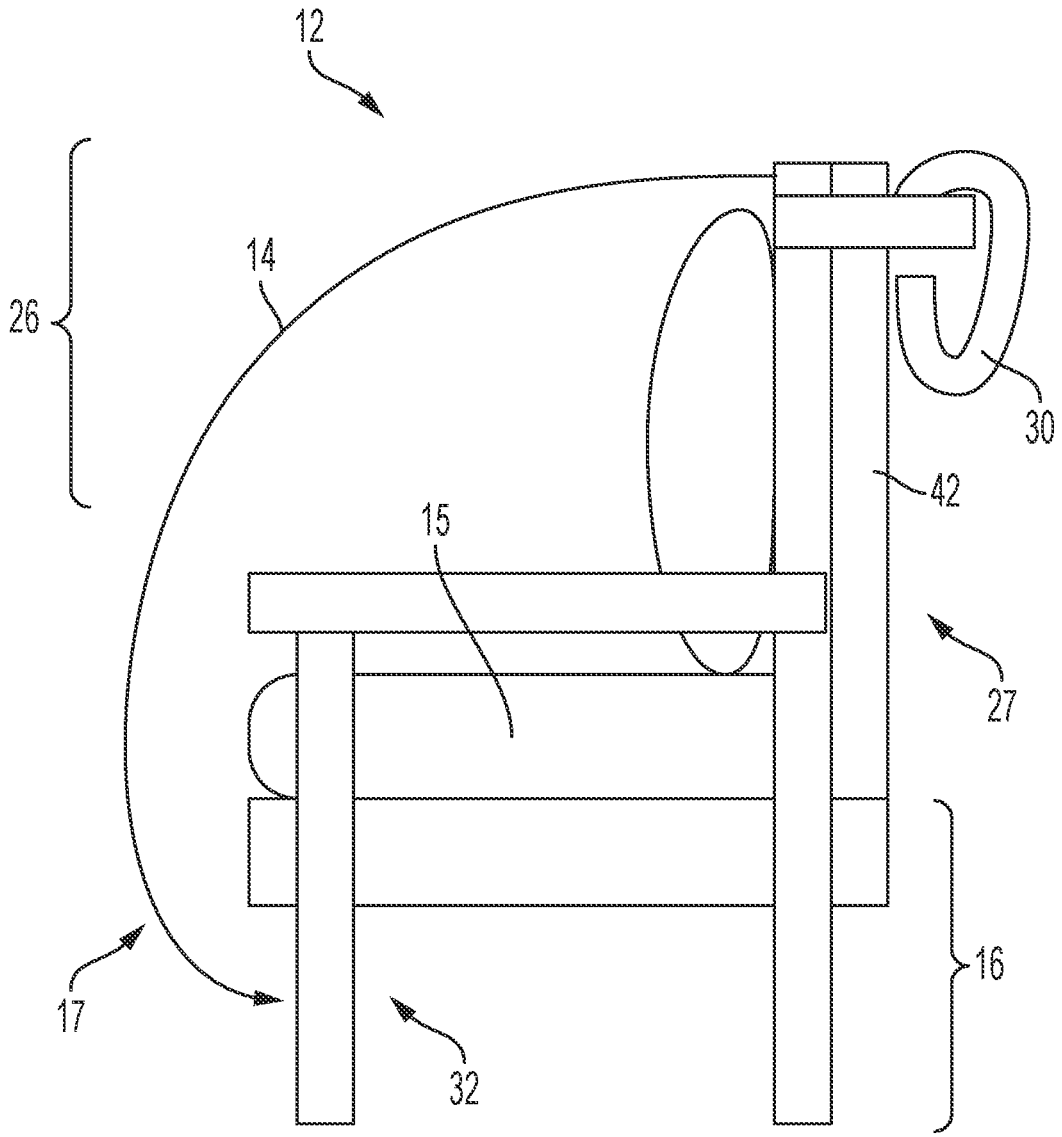

In FIG. 3A and FIG. 3B, in another embodiment, the covering 14 can be coupled to a spring mechanism 30 located about an upper portion 26 of a back support 42 of the article of furniture 12. In this embodiment, an edge of the covering 14 may include protrusions that are designed to fit tabs 32 located on a lower portion 16 of the article of furniture 12. Here again, the spring mechanism 30 may be resident in a storage device, such as a solid tube or backpack type of device. In other words, the spring mechanism 30 may be a rotatable device such that the covering 14 may be rotatable. In operation, drawing the covering 14 from the spring mechanism 30 and securing it to the tabs 32 results in the covering 14 spanning across the article of furniture 12. In one embodiment, the covering 14 includes attachment devices such as buttons or a hook and loop fastening material (e.g., Velcro®) that mates with a corresponding slot or hook and loop fastening material located on a lower portion of a seat support of the article of furniture 12. In some embodiments, the corresponding attachment device may be located on an upper portion 26 of a back support 42 of the article of furniture 12.

In one embodiment, the spring mechanism 30 may be electrically powered, mechanically powered or manually actuated. If electrically powered, the spring mechanism 30 may be coupled to a power cord for plugging into a power outlet as can be appreciated by one skilled in the art.

In one embodiment, the spring mechanism 30 may be a first attachment device. As discussed above and shown in FIG. 3B, the first attachment device can be on the upper portion 26 of the article of furniture 12. In an alternative embodiment, although not shown, the first attachment device may be integrated with the covering 14. Complementary to the first attachment device is a second attachment device, which can be similar to the tabs 32 disclosed above. The second attachment device can be located on the lower portion 16 of the article of furniture 12. In operation, the second attachment device can be configured to receive the first attachment device, or vice versa, to ensure that the covering 14 is secured to the article of furniture 12.

In one embodiment, the first attachment device can be a latch or a catch, while the second attachment device can be a recess, or a groove configured to receive the latch or the catch. In another embodiment, the first attachment device can be a spring while the second attachment device can be a tab configured to receive the spring.

Figure 4A:
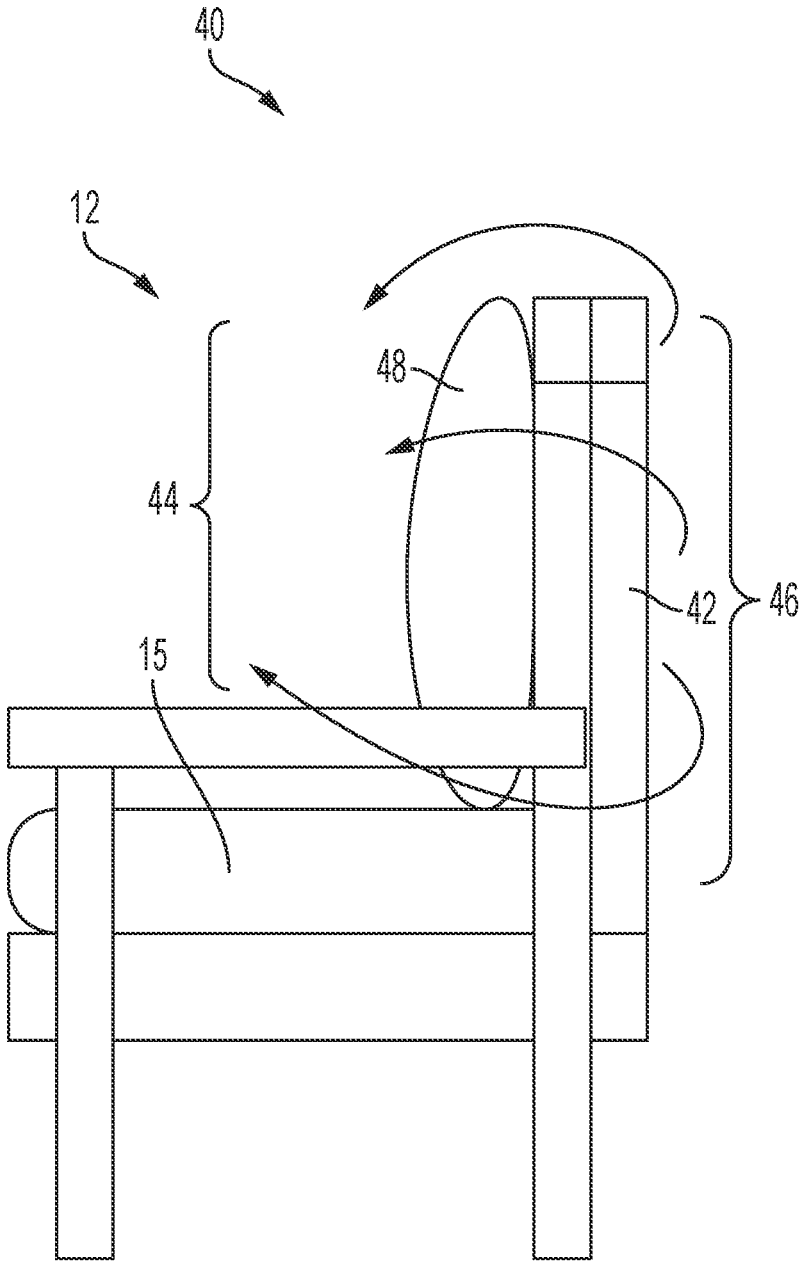
FIGS. 4A and 4B illustrate a third embodiment of an exemplary system.
Figure 4B:
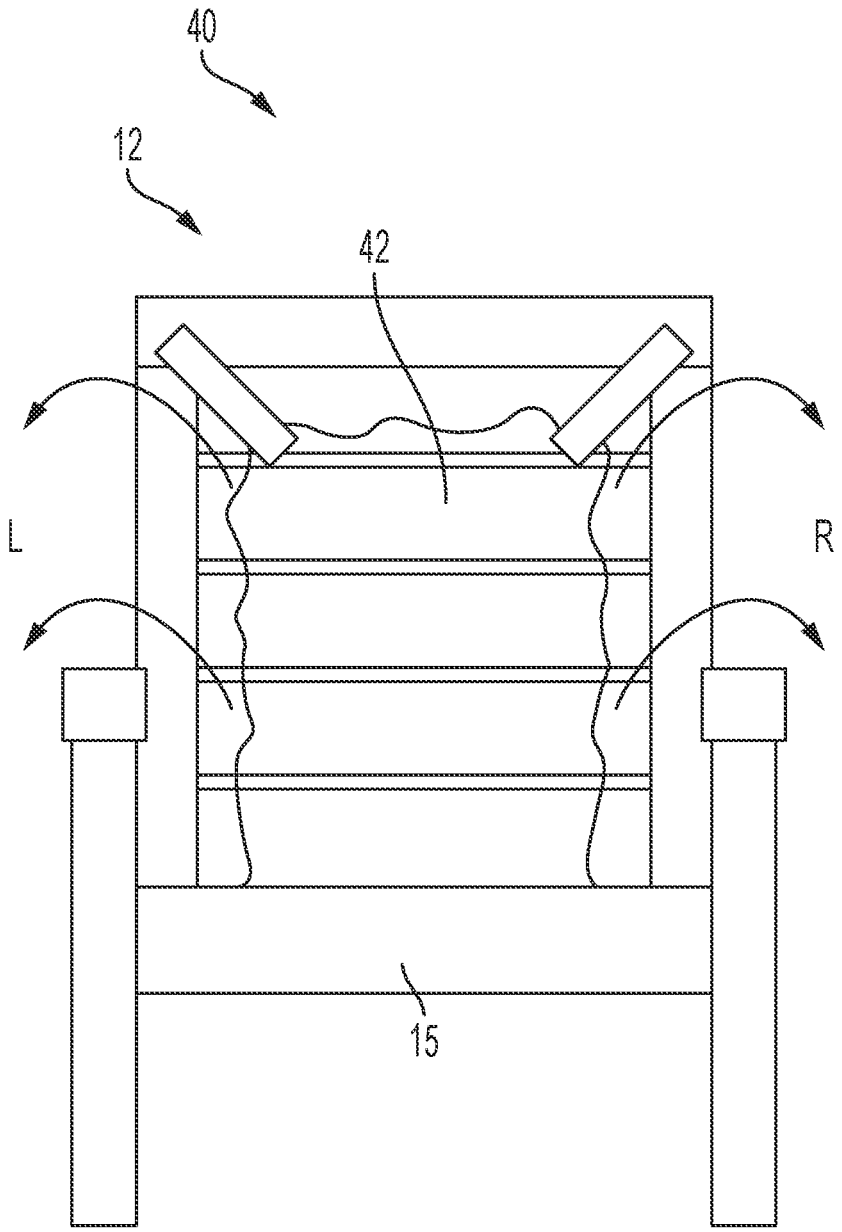

As shown in FIG. 4A and FIG. 4B, disclosed is an exemplary embodiment of a system 40 whereby a covering 14 can be adjacent the back support 42 of the article of furniture 12. For instance, the covering 14 can be coupled along portions of the back support 42 of the article of furniture 12.

In one embodiment, the covering 14 can be adjacent a rear portion 46 of the back support 42, as best illustrated in FIG. 4A. In another embodiment, the covering 14 can be adjacent a front portion 44 of the back support 42, as best illustrated in FIG. 4B.

FIG. 4A and FIG. 4B each illustrate an article of furniture 12 having a back support 42. In this embodiment, when the article of furniture 12 is a chair, the front portion 44 of the back support 42 is typically the area that receives a user's back when the user is seated on the seat bottom 15, while the rear portion 46 of the back support 42 is the backside of the back support 42.

In one embodiment, the covering 14 may be adjacent the back support 42. Regardless of whether the covering 14 is adjacent the front portion 44 or the rear portion 46 of the back support 42, the covering 14 is configured to extend from the back support 42 to at least one of an upper portion, a lower portion, a front portion and/or a rear portion of the article of furniture 12 so as to shield or protect the article of furniture 12 from external elements.

FIG. 4A illustrates the covering 14 adjacent the rear portion 46 of the back support 42. In one embodiment, the covering 14 can be stored within a storage compartment along the rear portion 46 of the back support 42. For example, the storage compartment can be a hollow false back with a hinged top that forms a part of the back support 42. In other words, the back support 42 can have sufficient thickness and volume so as to allow the covering 14 to be stored therein and extended from the rear portion 46 thereof. In operation, the covering 14 may be pulled or extended from the rear portion 46 toward the front portion 44 for covering the article of furniture 12 as best represented by the arrows in FIG. 4A. In doing so, the covering 14 may also cover any pillows or cushions 48 that may be on the front portion 44 of the back support 42.

FIG. 4B illustrates the covering 14 adjacent the front portion 44 of the back support 42. In one embodiment, the covering 14 can be stored within a pillow or cushion 48 of the article of furniture 12. As FIG. 4B illustrates the in-use configuration, the pillow or cushion 48 has since been converted from the storage configuration whereby the covering 14 has been extended. It will be appreciated by one skilled in the art that the pillow or cushion 48 can be integrated into the back support 42 or be provided as a standalone unit, optionally coupled with fasteners to the back support 42.

In operation, when the covering 14 is stored within a pillow or cushion 48 and ready to be extended into in-use mode, the covering 14 can be extended toward the front, back or sides of the article of furniture 12 as best illustrated by the arrows in FIG. 4B. In other words, the covering 14 may be stored within the pillow or cushion 48, whereby an opening in the cushion 48 may allow the covering 14 to be removed therefrom. Once removed, the covering 14 can extend to the left side (L) of the article of furniture 12, to the right side (R) of the article of furniture 12, or the top and bottom sides (bottom side arrows not shown) of the article of furniture 12. Once removed, the covering 14 can be extended to cover the entire article of furniture 12. If there are multiple portions of the covering 14, these can be secured to each other with fasteners similar to those described above to not only secure portions of the covering 14 to each other but to also ensure that the covering 14 is secured to the article of furniture 12.

In one embodiment, when the covering 14 has been extended, whether from the front portion 44 or the rear portion 46 of the back support 42, an elastic material may aid in securing the covering 14 over the article of furniture 12 as best described below and shown in FIG. 5.

Figure 5:
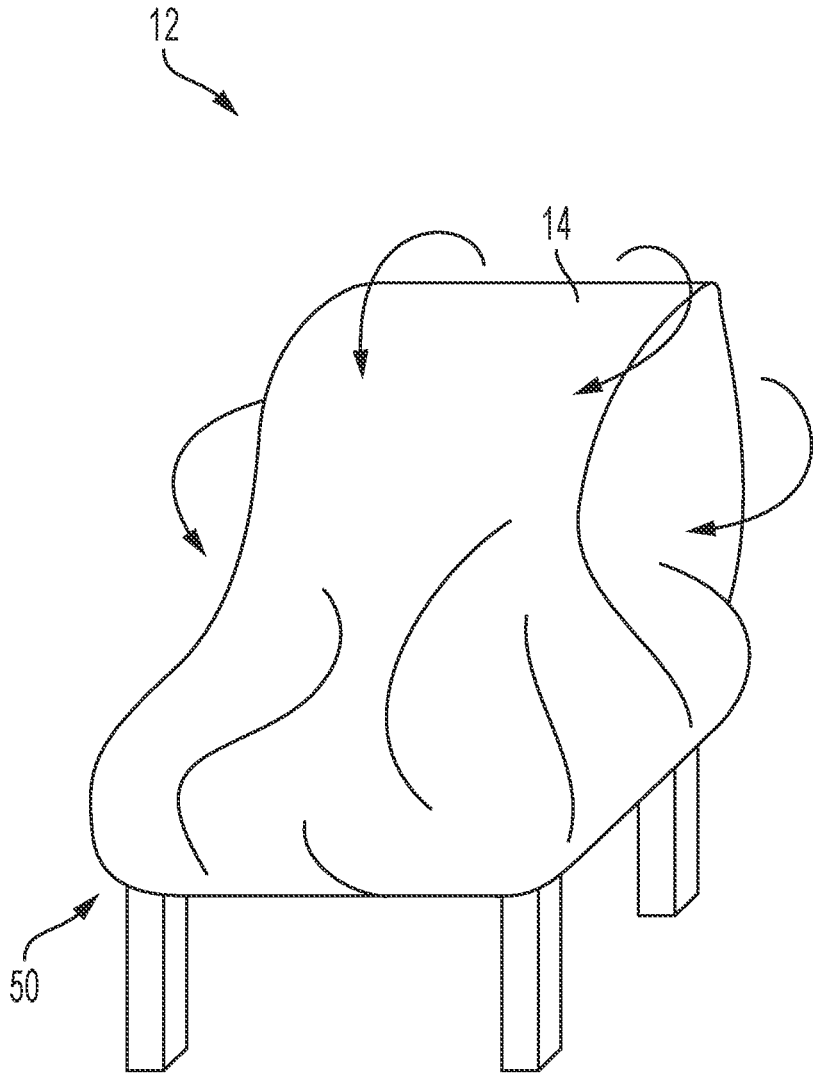
FIG. 5 illustrates a retractable covering over an article of furniture.

As shown in FIG. 5 in an in-use configuration, elastic materials 50 can be positioned (e.g., around the edges or along the borders) about the covering 14 and used to fit the covering 14 to the particular size and/or shape of the article of furniture 12. In other words, the covering 14 can include an elastic material such that the covering 14 is able to make physical contact with various parts of the article of furniture 12. In other words, because of the elastic properties of the materials 50 in providing the necessary compressive force, the elastic material 50 will ensure that the covering 14 maintain a tight fit with the article of furniture 12 such that the covering 14 remains in place in the event of wind or heavy precipitation, as the elastic properties of the elastic material 50 will ensure that the covering 14 makes physical contact with the upper portion 26, the lower portion 16, the front portion 17 and/or the rear portion 27 of the article of furniture 12.

In some embodiments, the covering 14 may include ribs and/or spring pop-like tent bars to aid in a covering operation.

Figure 6:
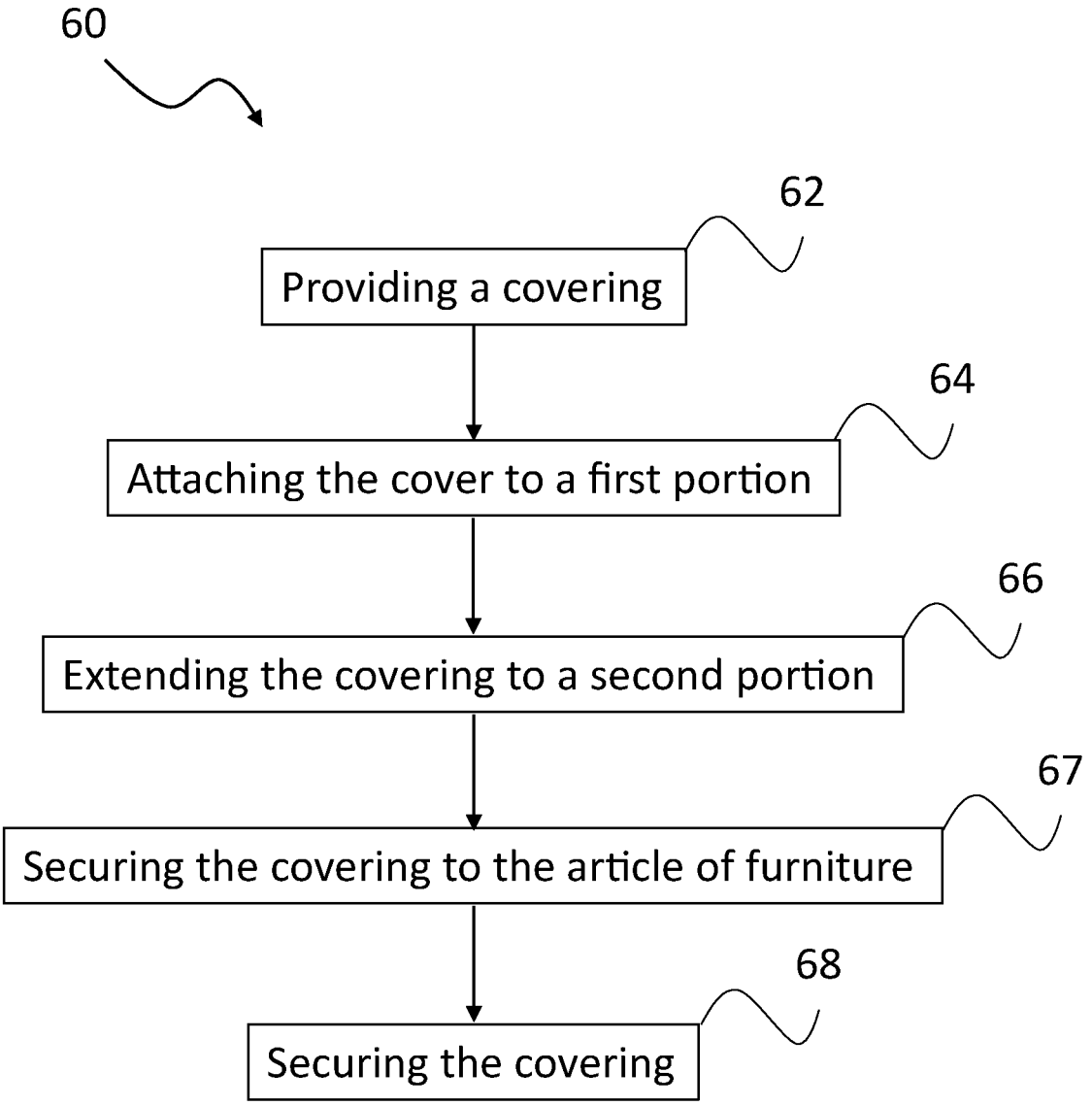
FIG. 6 is a flow diagram of the methods of using the disclosed exemplary systems.

FIG. 6 is a flow diagram illustrating various methods 60 of using the disclosed exemplary systems 10. In one embodiment, a method 60 of using the disclosed self-contained outdoor furniture covering system 10 includes a providing step 62, where a covering 14 for an article of furniture 12 is provided. Next is an attaching step 64, whereby the covering 14 is attached to a first portion of the article of furniture 12 similar to those described above. The next step of the process is an extending step 66, such that the covering 14 is extended from the first portion to a second portion of the article of furniture 12. In doing so, the covering 14 is operable to shield at least one of an upper portion, a lower portion, a front portion, and a rear portion of the article of furniture 12 from external elements.

In one embodiment, the next step of the method 60 is a securing step 67, including securing the covering 14 to the article of furniture 12 with first attachment device and second attachment device. In an embodiment, the first attachment device can be on the covering 14 and the second attachment device can be on the second portion of the article of furniture 12. In an alternative embodiment, the first attachment device can be on the second portion of the article of furniture 12 and the second attachment device can be on the covering 14. Regardless of the positioning of these attachment devices, they are able to be configured so as to receive one another so as to secure the covering 14 to the article of furniture 12.

In one embodiment, the next step of the method 60 is an optional securing step 68, including securing a first portion of the covering 14 to a second portion of the covering 14 similar to that described in FIG. 1. In this embodiment, the securing step 68 can be achieved with a fastener, where the fastener can be zipper, magnet, or hook and loop fasteners, among others.

While example embodiments have been particularly shown and described, it will be understood by those skilled in the art that various changes in form and details may be made therein without departing from the scope of the embodiments encompassed by the appended claims. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A system comprising:

an article of furniture; and a covering configured to be deployed from a stored configuration located in a storage housing attached to a first portion of the article of furniture, the storage housing including a spring-loaded roller around which the covering is wrapped when the covering is not deployed, the covering further configured to extend from the first portion to a second portion of the article of furniture for shielding at least one of an upper portion, a lower portion, a front portion and a rear portion of the article of furniture from external elements; and wherein the covering comprises a handle on one end for facilitating drawing the covering from the storage housing; and wherein the article of furniture comprises a receiver notch located in the second portion and configured to receive and retain the handle when the covering is deployed.

2. The system of claim 1, wherein the covering further comprises an elastic material such that the covering makes physical contact with the at least one of the upper portion, the lower portion, the front portion and the rear portion.

3. The system of claim 1, wherein the first portion is located along at least one of the lower portion and the front portion and the second portion is located along at least one of the rear portion and the upper portion.

4. The system of claim 1, wherein the first portion is located along at least one of the rear portion and the upper portion and the second portion is located along at least one of the lower portion and the front portion.

5. The system of claim 1, wherein the covering further comprises a fastener for securing a first lateral portion of the covering to a second lateral portion of the covering.

6. The system of claim 5, wherein the fastener is selected from the group consisting of zipper, magnet, and hook and loop fastener.

7. A system comprising:

an article of furniture having a back support; and a covering stored in a storage compartment adjacent the back support, the covering configured to extend from the back support to at least one of an upper portion, a lower portion, a front portion and a rear portion of the article of furniture for shielding the article of furniture from external elements.

8. The system of claim 7, wherein the covering is stored within a cushion adjacent a front portion of the back support.

9. The system of claim 7, wherein the covering further comprises an elastic material such that the covering makes physical contact with the at least one of the upper portion, the lower portion, the front portion and the rear portion.

10. The system of claim 7, wherein the covering further comprises a fastener for securing a first lateral portion of the covering to a second lateral portion of the covering, and wherein the fastener is selected from the group consisting of zipper, magnet, and hook and loop fastener.

11. A method comprising:

providing a system according to claim 1.

12. The method of claim 11, wherein the covering is secured to the article of furniture with a first attachment device configured to receive a second attachment device, wherein the first attachment device is disposed about at least one of the covering and the second portion and the second attachment device is disposed about the other of the at least one of the covering and the second portion.

13. The method of claim 11, wherein a first lateral portion of the covering is secured to a second lateral portion of the covering with a fastener, wherein the fastener is selected from the group consisting of zipper, magnet, and hook and loop fastener.

14. The system of claim 7, wherein the storage compartment includes a spring-loaded roller around which the covering is wrapped when the covering is not deployed; and, wherein the covering comprises a handle on one end for facilitating drawing the covering from the storage compartment; and wherein the article of furniture comprises a receiver notch located in the lower portion and configured to receive and retain the handle when the covering is deployed.

* * * * *